US006119490A

United States Patent [19]

Schierz et al.

[11] Patent Number: 6,119,490

[45] Date of Patent: Sep. 19, 2000

[54] MATERIAL FOR SOUND-ABSORBENT AND HEAT-INSULATING LINING OF AN AUTOMOTIVE ENGINE COMPARTMENT

[75] Inventors: Claus Schierz, Freilberg; Jochen Schreiber, Chemnitz; Walter Kittelmann, Dresden, all of Germany

[73] Assignee: Asglawo GmbH - Stoffe Zum Dammen und Verstarken, Hilbersdorf, Germany

[21] Appl. No.: 09/284,656

[22] PCT Filed: Oct. 10, 1997

[86] PCT No.: PCT/EP97/05607

§ 371 Date: Jun. 17, 1999

§ 102(e) Date: Jun. 17, 1999

[87] PCT Pub. No.: WO98/16676

PCT Pub. Date: Apr. 23, 1998

[30] Foreign Application Priority Data

Oct. 16, 1996 [DE] Germany ..... 196 42 714

[51] Int. Cl.[7] ..... D04B 21/14; D04B 21/20

[52] U.S. Cl. ..... 66/170; 66/191; 66/192; 66/194; 66/195; 66/202

[58] Field of Search ..... 66/169 R, 170, 66/190, 191, 192, 193, 194, 195, 196, 202; 442/304, 312, 318, 319

[56] References Cited

U.S. PATENT DOCUMENTS

| | | | |
|---|---|---|---|
| 1,721,096 | 7/1929 | Steffens | 66/192 |
| 2,372,497 | 3/1945 | Johnson et al. | 66/192 |
| 4,197,723 | 4/1980 | Ehedy et al. | 66/192 |
| 4,631,933 | 12/1986 | Carey et al. | 66/192 |
| 5,395,684 | 3/1995 | Robinson et al. | 66/196 |
| 5,549,965 | 8/1996 | Heinrich et al. | 66/192 |

*Primary Examiner*—Danny Worrell
*Attorney, Agent, or Firm*—Herbert Dubno

[57] ABSTRACT

The invention relates to a moulded part which can be used as a sound absorbent and heat insulating lining for an automotive engine compartment. Said moulded article consists of a carbon-fiber heat insulating layer (1) facing the engine compartment, a rear thermoplastic-fiber supporting layer (2) and a sound absorbent insert (3). Heat insulating layer (1) and supporting layer (2) are designed as a non-woven knitted fabric comprising a stitched layer which binds all fibers and is made of flatly disposed stitches, and a looped protruding pile layer. Stitched layers (4,4') of heat insulating layer (1) facing engine compartment, and rear supporting layer (2) define the outer surface of the material. Supporting layer (2) is moulded by hot pressing to form a dimensionally stable moulded part.

9 Claims, 4 Drawing Sheets

MATERIAL FOR SOUND-ABSORBENT AND HEAT-INSULATING LINING OF AN AUTOMOTIVE ENGINE COMPARTMENT

CROSS REFERENCE TO RELATED APPLICATIONS

This application is the U.S. national phase of PCT application PCT/EP97/05607 filed Oct. 10, 1997 with a claim to the priority of German application 196 42 714.2 itself filed Oct. 16, 1996.

FIELD OF THE INVENTION

DESCRIPTION

The invention relates to a material for sound-absorbent and heat-insulating lining of an automotive engine compartment. The material is formed into a molded part and usable as a rigid wall element, housing element, or the like.

The material is mounted in the engine compartment of a motor vehicle and is intended to reduce sound and heat emissions as much as possible. It is mounted on the firewall between the engine and passenger compartments and can also be mounted on the underside of the hood and can be used to encapsulate the engine. The material must be sufficiently heat resistant to withstand the temperatures produced by the vehicle and also be nonflammable, and have a surface that is water- and oil-shedding, as well as resistant to dirt. Of course it also must have limited thermal conductivity and the ability to absorb considerable sound.

In practice glass fibers are added to the fleeces stabilized for the named purposes with phenolic resins with the hot front side being covered with a fleece of glass fibers. The surface weight of the known motor-compartment lining is considerable and the heat-insulating capacity as well as the sound-absorbing capacity could be improved relative to the amount of material used.

German 4,114,408 describes a textile damping material that is made of a pile fleece knit which is formed of a stitch layer holding all fibers and formed of flat stitches as well as upstanding loops. Glass fibers are inserted and also fiber mixtures of glass fibers and carbon fibers are possible. The material is voluminous and one side of the material has a terry or plush-like structure that holds dirt and which can only be adhered with difficult to body parts. It cannot be made rigid for use as a structural part.

Similarly German 4,125,351 describes a textile damping material that is formed of two fiber layers that each have a stitch layer and a layer of upstanding loops. The stitch layers are arranged on the outer faces with the loops forming an intermediate cushion. One layer of fibers can be made of carbon fibers and the other layer can be of natural or synthetic fibers. The material is voluminous and has good heat-damping capacity. Its sound absorbency, in particular the absorption of body noises, is unsatisfactory. As a result of the inadequate sound-absorbing capacity the material is also not suitable for the above-described application. Even this material cannot be made stiff for structural use.

It is an object of the invention to provide a material for the sound- and heat-absorbent lining of the engine compartment of a motor vehicle that has a high heat-insulating capacity, is heat-resistant, that has a dirt-resisting surface, that can easily be used as a structural part in the engine compartment, and whose sound-absorbing capacity is suitable for this use. The material should according to application reduce emission of body sounds and/or air sounds considerably.

The invention and solution of this object is a material for sound-absorbent and heat-insulating lining of an automotive engine compartment comprising

- a heat-insulating layer of carbon fibers turned toward the engine compartment,
- a rear carrier layer, and
- at least one sound-absorbing core layer, the heat-insulating layer and the carrier layer each being formed of a pile fleece knit which has a stitch layer of flat stitches holding all fibers as well as a pile loop layer of upstanding cushion-forming loops, the stitch layer which forms the heat-insulating layer turned toward the engine compartment and the back carrier layer which forms the outer faces of the material and the carrier layer being formed of thermoplastic fibers and being formable by hot pressing into a structurally stable body. The stitch layer of the heat-insulating layer preferably has oil- and water-repelling properties.

The carbon-fiber heat-insulating layer has considerable heat resistance. The pile loops, which can have a height of 10–20 mm, form a cushion with considerable heat-insulating properties. As a result of the high heat-insulating capacity of the carbon-fiber heat-insulating layer the materials for the carrier layer and the core layer can be selected freely. The material and formation of the carrier layer as well as of the core layer are selected according to application. The selection is made so that the sound absorbency is increased so that as a result of the material selected and its construction body sounds and/or air sounds can be selectively reduced. Hot pressing of the thermoplastic-fiber carrier layer forms a structural part that can be used as a rigid shell and for example as a deflector wall, housing half for a motor, or the like. Possibilities of further formations are described more closely in the following.

It is within the scope of the invention that the stitch layer of the heat-insulating layer lies on the pile loops of the back carrier layer and the loops of the heat-insulating layer is mounted on the stitch layer of the back carrier layer and the loops extend through the core layer.

Another embodiment of the invention is that the loops of the heat-insulating layer and the rear carrier layer end at and are stitched into the core layer. The material, thickness, and weight of the core layer can be freely selected. According to a preferred embodiment the core layer is formed of body-sound-absorbing needle felt or a mechanically stabilized fleece, e.g. of cotton card fibers, and has a layer density that is greater than the density of the pile-fleece knits it is sandwiched between. The result is a particularly voluminous material with very good heat- and sound-insulating properties as compared to the above-described systems.

With all the above-described embodiments the core layer can be a body-sound-absorbing needle felt, a mechanically stabilized fleece, and the like. It is further possible according to the invention to use a pile-fleece knit which has upstanding pile loops and a layer of coplanar stitches holding all the fibers of the core layer, the stitch layer of the heat-insulating layer lying on the pile loops of the core layer and the pile loops of the heat-insulating layer as well as of the carrier layer being worked into the stitch layer of the sound-insulating layer. This embodiment is ideal when the least possible air-sound emissions are required.

The core layer can be made of many types of fibers. Preferably cotton, aramide, heat-resistant polyester, and mixtures of these fibers are used. Cotton fibers improve the acoustic performance of the material; aramide fibers and heat-resistant polyester fibers are recommended when very high temperatures are being encountered and a particularly high heat-insulating capacity is required.

The invention is described more closely in the following with reference to a drawing showing only one embodiment.

FIGS. 1 to 4 schematically show a longitudinal section through a material for sound-absorbent and heat-insulating lining of an automotive engine compartment in various embodiments.

Figure 1:
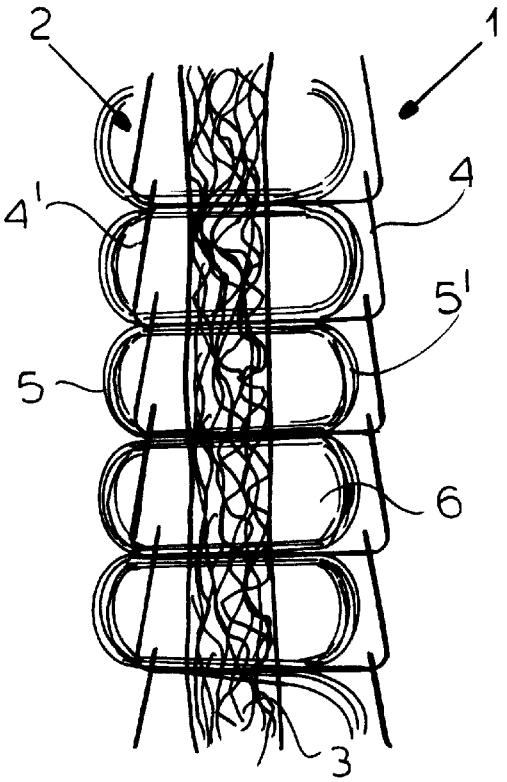

The material shown in the figures consists of a carbon-fiber heat-insulating layer 1 turned toward the engine compartment, a back carrier layer 1 of thermoplastic fibers, and at least one sound-insulating layer 3. The heat-insulating layer 1 is formed of a pile-fleece knit which has a stitch layer 4 of flat stitches holding all carbon fibers and a pile loop layer formed of upstanding cushion-forming pile loops 5. The stitch layer 4 is provided with an oil- and water-shedding additive. Such oliophobic and hydrophobic coating agents are known.

The carbon-fiber heat-insulating layer 1 is characterized by a high temperature resistance and has as a result of the cushion 6 formed by the pile loops 5 good heat-insulating capacity. This makes it possible to freely select the material and construction of the sound-absorbing layer 3 as well as of the carrier layer 2 and to adjust them depending on application. The back carrier layer 2 is formed as a pile-fleece knit which has a stitch layer 4' of flat stitches holding all fibers of the carrier layer 2 and a pile-loop layer formed by upstanding pile loops 5'. Thus the stitch layers 4 and 4' form outer surfaces of the material on the heat-insulating layer 1 turned toward the engine compartment and on the back carrier side 2. These surfaces are smooth, not likely to catch dirt, and can easily be secured to the vehicle body. Many possibilities are available for the core layer 3.

In the embodiment of FIG. 1 the stitch layer 4 of the heat-insulating layer 1 on the pile-loop layer of the back carrier layer 2 and the pile loops 5 of the heat-insulating layer are worked into the stitch layer 4' of the back carrier layer 2. The pile loops 5 and 5' extend through the core layer 3.

Figure 2:
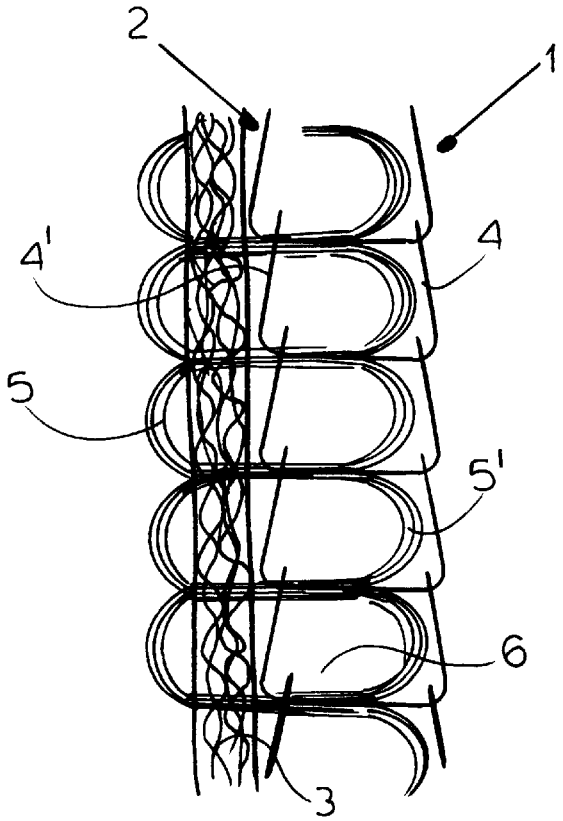

FIG. 2 shows a similar embodiment. The core layer 3 lies on the stitch layer 4' of the back carrier layer 2 and is traversed by the pile loops 5 formed of carbon fibers of the heat-insulating layer 1 turned toward the engine compartment.

Figure 3:
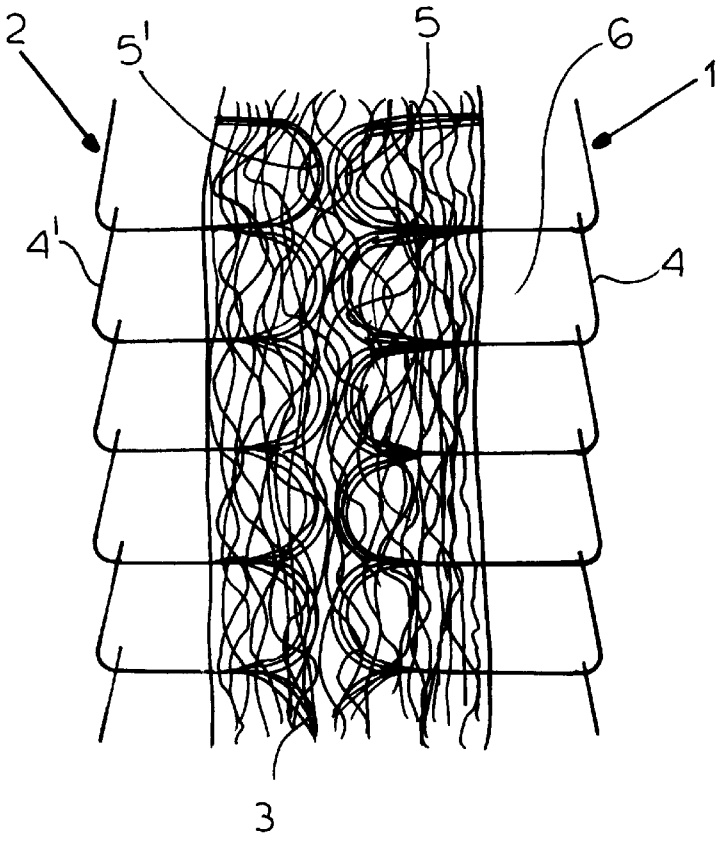

In the FIG. 3 embodiment the pile loops 5 and 5' define the heat-insulating layer 1 and the back carrier layer 2 in the core layer 2 and are enmeshed in the core layer 3. The core layer 3 of the embodiments of FIGS. 1 to 3 can comprise a body-sound-absorbing needle felt or a mechanically stabilized fleece material. Good sound insulation is in particular obtained with a core layer 3 of cotton fibers. In the embodiment according to FIG. 3 the thickness of the core layer 3 can vary widely. According to a preferred embodiment the core layer 3 is formed of a mechanically stabilized fleece of cotton card fibers and has a thickness between 10 and 25 mm. The pile-fleece knits on both sides are thinner and have a thickness of about 5 mm.

Figure 4:
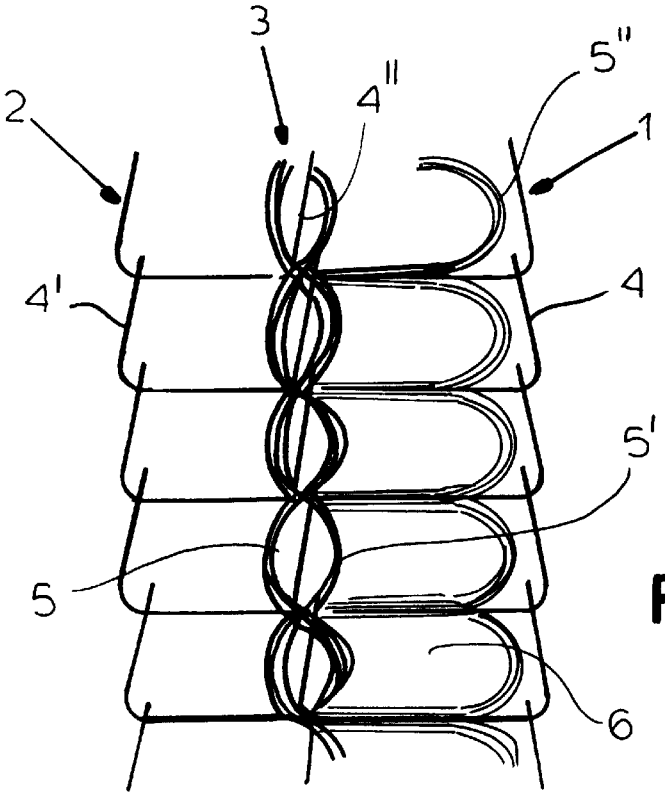

In the embodiment of FIG. 4 the core layer is a pile-fleece knit which has a stitch layer 4" of flat stitches holding all the fibers of the core layer 3 and upstanding pile loops 5", the stitch layer 4 of the heat-insulating layer 1 lying on the pile loops 5" of the core layer 3 and the pile loops 5 and 5' of the heat-insulating layer 1 and of the carrier layer being worked into the stitch layer 4" of the core layer 3. The pile-fleece knit forming the core layer 3 consists in this embodiment of heat-resistant aramide fibers and/or temperature-resistant polyester fibers or a mixture of these fibers.

Figure 5:
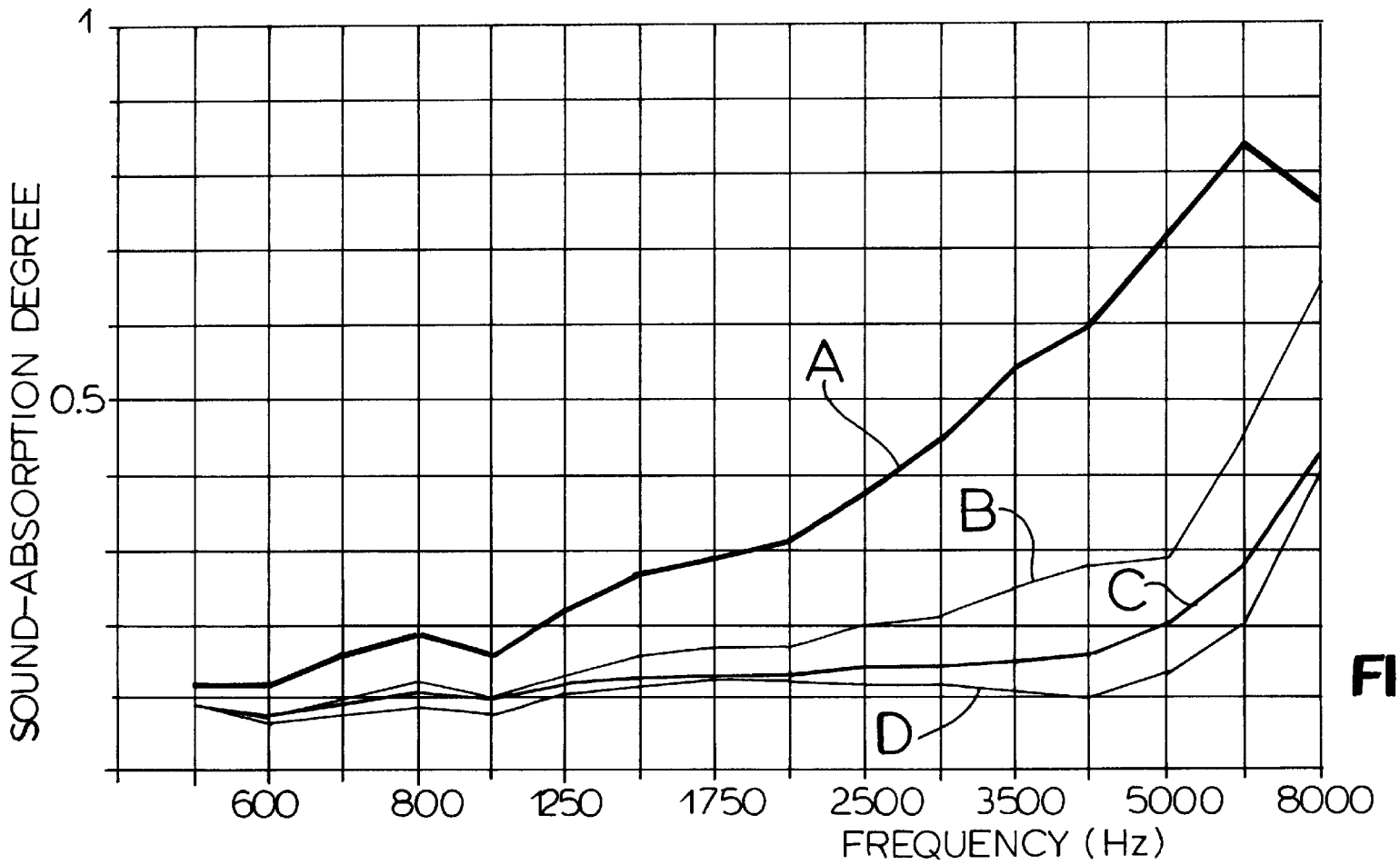
FIG. 5 shows with comparative measurements the sound-absorption capacity of the material according to the invention.

FIG. 5 shows the results of comparative measurements between a material A according to the invention not hot-pressed into a structural part with the construction shown in FIG. 3, of an insulating material B according to German 4,125,351, an insulating material C according to German 4,114,408, and a mechanically stabilized cotton fleece D. The compared materials had the same physical strengths. The degree of sound absorption according to frequency of the sound waves is shown. The material A according to the invention has a significantly better degree of sound absorption as the known insulating materials B to D. The improvement is particularly significant in the higher frequency range.

Figure 6:
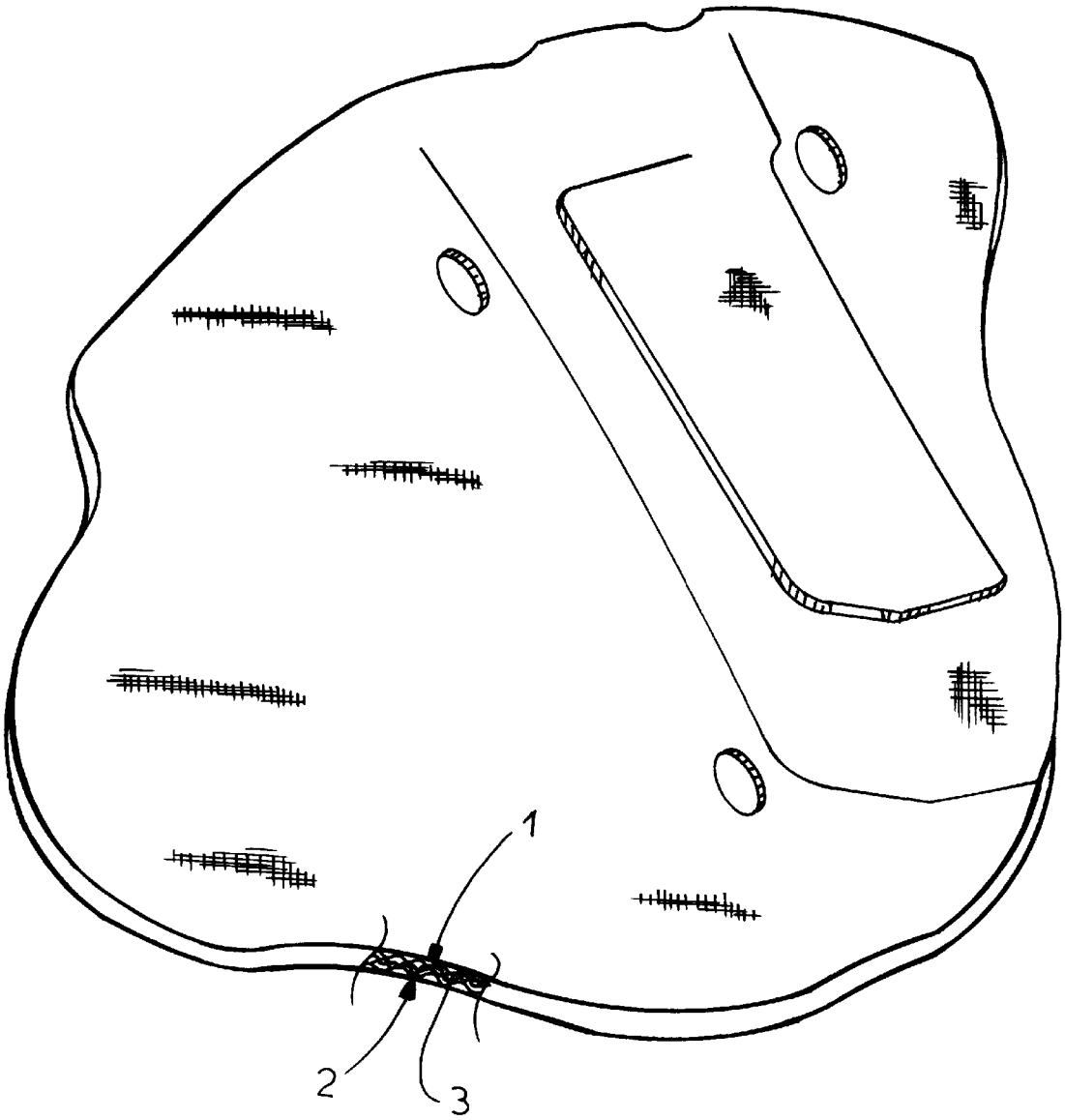
FIG. 6 shows in perspective view a portion of a hot-pressed structural part of the material according to the invention.

The carrier layer 2 consists of polyester fibers. The carrier layer 2 is hot pressed into a structural part which can be used as a rigid shell, for example as a spray wall, housing half shell for a motor, or the like. FIG. 6 shows a structural part for the inner face of the hood of a motor vehicle. The structural part is a rigid body and has a shape corresponding to the vehicle hood.

What is claimed is:

1. A material for sound-absorbent and heat-insulating lining of an automotive engine compartment comprising a heat-insulating layer of carbon fibers for placement adjacent the engine compartment, a rear carrier layer and at least one sound-absorbing core layer, the heat-insulating layer and the carrier layer each being formed of a pile fleece knit which has a stitch layer of flat stitches holding all fibers as well as a pile loop layer of upstanding cushion-forming loops, the stitch layer which forms the heat-insulating layer for placement adjacent the engine compartment and the back carrier layer which forms the outer faces of the material and the carrier layer being formed of thermoplastic fibers and being formable by hot pressing into a structurally stable body.

2. The material according to claim 1 wherein the stitch layer of the heat-insulating layer has oil- and water-repelling properties.

3. The material according to claim 1 wherein the stitch layer of the heat-insulating layer lies on the loops of the back carrier layer and the loops of the heat-insulating layer is mounted on the stitch layer of the back carrier layer and the loops extend through the core layer.

4. The material according to claim 1 wherein the loops of the heat-insulating layer and the rear carrier layer end at and are stitched into the core layer.

5. The material according to claim 1 wherein the core layer is formed of body-sound-absorbing needle felt.

6. The material according to claim 1 wherein the core layer is formed of a mechanically stabilized fleece of cotton card fibers.

7. The material according to claim 1 wherein the core layer is a pile-fleece knit which has upstanding pile loops and a layer of coplanar stitches holding all the fibers of the core layer, the stitch layer of the heat-insulating layer lying on the pile loops of the core layer and the pile loops of the heat-insulating layer as well as of the carrier layer being worked into the stitch layer of the sound-insulating layer.

8. The material according to claim 7 wherein the pile-fleece knit of the core layer is made of aramide fibers, heat-resistant polyester fibers, cotton fibers, or a mixture of these fibers.